United States Patent [19]

Ohashi

[11] Patent Number: 4,611,471

[45] Date of Patent: Sep. 16, 1986

[54] ICE MAKING APPARATUS PARTICULARLY FOR AN ICE RINK

[75] Inventor: Kazuo Ohashi, Tokyo, Japan

[73] Assignee: Kabushiki Kaisha Patine Shokai, Tokyo, Japan

[21] Appl. No.: 691,269

[22] Filed: Jan. 14, 1985

[30] Foreign Application Priority Data

Mar. 2, 1984 [JP] Japan ..... 59-14812

[51] Int. Cl.[4] ..... F25C 3/02

[52] U.S. Cl. ..... 62/235; 165/133; 165/163

[58] Field of Search ..... 62/235; 165/46, 133, 165/163; 242/78.1–78.8; 148/36

[56] References Cited

U.S. PATENT DOCUMENTS

| | | | |
|---|---|---|---|
| Re. 29,438 | 10/1977 | MacCracken et al. | 62/235 X |
| 2,878,651 | 3/1959 | Heinzelman | 62/235 |
| 3,268,989 | 8/1966 | Erwin et al. | 165/133 X |
| 3,388,562 | 6/1968 | Harle | 165/133 X |
| 3,711,327 | 1/1973 | Blumenthal et al. | 165/133 X |
| 3,751,935 | 8/1973 | MacCracken et al. | 62/235 X |
| 4,007,781 | 2/1977 | Masters | 165/46 |
| 4,193,180 | 3/1980 | Preso | 165/133 X |
| 4,394,817 | 7/1983 | Remillard | 165/46 X |

*Primary Examiner*—William E. Tapolcai

*Attorney, Agent, or Firm*—Frishauf, Holtz Goodman & Woodward

[57] ABSTRACT

An apparatus for forming an ice layer over a wide area such as a skating rink is disclosed. A freezing medium including a liquefied gas such as freon or ammonia or an anti-freeze liquid such as brine or ethylene glycol is circulated through a freezing pipe laid in the wider area such as skating rink. According to the invention, the freezing pipe is of a nature that can be wound or extended under pressure application and is formed as an elongated soft steel pipe having a coating of synthetic material on the outer surface or on both the inner and outer surfaces of the pipe.

11 Claims, 5 Drawing Figures

ICE MAKING APPARATUS PARTICULARLY FOR AN ICE RINK

BACKGROUND OF THE INVENTION

1. Field of the Invention

This invention relates to an ice forming apparatus and more particularly to such apparatus used for forming a solid ice layer on a relatively wide area such as a skating rink.

2. Prior Art

Formerly, in forming and maintaining a solid ice layer in the skating rink, the conventional practice is to lay a large number of freezing pipes consisting of bare steel pipes or synthetic resin pipes on a given site such as rink floor, and a liquefied gas such as freon or ammonia or an antifreeze liquid such as brine or ethylene glycol is circulated as freezing medium or refrigerant through the pipes for forming and maintaining the ice layer. A large number of such freezing pipes are each connected at one end to a refrigerant supply header and at the other end to a refrigerant return or outlet header. These headers are further connected to a freezing unit by way of feed and return pipes for circulating the refrigerant from the freezing pipe through the feed pipe, supply header, freezing pipe, outlet header and outlet pipe in this order and back to the freezing unit to complete a freezing cycle.

When freezing pipes are laid widthwise of the skating rink, the number of the freezing pipes may inevitably be increased, and the pipe installation operation is also complicated with additional costs. Hence, it is more customary that the freezing pipes be laid along the longitudinal direction of the rink in consideration of conveniences in the pipe installation operation, and cost efficiency.

Formerly, bare steel pipes have been used as freezing pipes. In recent times, however, resilient synthetic resin such as ethylene vinyl acetate (EVA) is preferred to steel as a freezing pipe material. The synthetic resin pipes are less costly and lightweight as compared with the steel pipes and may be made available in considerably long size, which facilitates transport, mounting and dismounting operations. Thus, the synthetic resin pipes may be advantageously employed with a multi-purpose sporting site serving both as a swimming pool during summer and as a skating rink during winter.

However, the synthetic resin pipe is not so durable as to be suited for long-term use and can hardly be used for a permanent rink or a skating rink made of reinforced concrete and having the freezing pipes permanently embedded in the concrete flooring, whereas the steel pipe is more durable and can be applied to such permanent rink.

One of the freezing systems for the skating rink is an indirect system in which an anti-freezing liquid, such as brine, is chilled in a freezing equipment comprising a heat exchanger to be circulated through the freezing pipe laid on a rink floor for freezing the water in the rink. Another freezing system is a direct system in which freon gas or ammonia is circulated directly through the freezing pipe and undergoes an expansion process for chilling the water. In case of the indirect freezing system, the freezing pipe is required to be large in diameter and wall thickness because of necessity for having the large amount of the anti-freezing liquid circulated in the freezing pipe. Thus, steel pipes are predominantly used in the indirect system, because it is technically difficult or unfeasible to use the synthetic resin pipe as freezing pipe for the indirect system.

As such steel pipes, naked pipes were used hithertofore as freezing pipes. This gives rise to the following inconveniences.

(1) The pipes in large lengths are usually kept from being used because of inconveniences in transport and installation operations as well as costs. Therefore, the pipes of shorter lengths such as those with lengths less than 5.50 meter are normally used so as to be necessarily welded at the construction site, causing additional labor and operational costs.

(2) In welding the pipe segments together, the welds are inevitably of a larger wall thickness and are liable to change in quality. Consequently, the welds exhibit a freezing effect different from that of the other pipe portions, and thus it is impossible to obtain an ice layer of uniform and homogeneous quality.

(3) The freezing medium may leak through the defective welds, in case of inadequate welding.

(4) Corrosion or pinholes may be generated in case of prolonged use. For avoiding the corrosion or pinholes, the pipe must have a sufficient wall thickness, which in turn gives rise to additional costs in material and increased difficulties in transport.

(5) In some countries, the use of freon or a similar liquefied gas is subject to government regulations. In Japan, for example, the following standards are set under the High Pressure Gas Regulation Act on the thickness of the pipe adapted for conveyance of the high pressure liquefied gas.

Wall thickness of pipe $>t+a$ with $$t=(pD^{\circ})/(200yz+0.8p)$$

where t=minimum thickness of the pipe in mm p=design pressure in $kg/cm^2$ $D^{\circ}$=outside diameter of pipe in mm y=allowance tensile stress of material in kg/mm z=efficiency of weld joint a=corrosion allowance of pipe The standards are also set on the corrosion allowance a in such a way that $a \geqq 1.00$ mm for a bare steel pipe and $a \geqq 0.5$ mm for a steel pipe with a corrosion resistant painting. Under these government regulations, the bare steel pipe need be of a relatively large wall thickness as compared with the inside diameter of the pipe. For an example, when the bare steel pipe with the inside diameter of 12 mm is used in the usual manner as the freezing pipe, it is required that the minimum wall thickness be 0.67 mm or more and the corrosion allowance be 1.00 mm or more, the wall thickness of the pipe being then 1.67 mm or more.

(6) In case of the direct system, it is necessary that a steel pipe of a relatively small diameter be used as freezing pipe because of the pressure of the circulating medium such as freon or its cost. However, since the requirement in the above (5) must be satisfied, the wall thickness becomes too large with the result that the tube is not utilized economically.

(7) When the bare steel tube is used as freezing pipe, it may be chilled abruptly and the water surrounding the freezing pipe is frozen abruptly. Consequently, the lower portion of the ice layer surrounding the freezing tube is not sufficiently compatible with the upper portion of the ice layer and the ice tends to be cracked along the boundary zone.

(8) The ice temperature about the freezing pipe becomes too low and the ice temperature control is also difficult.

(9) While the air tends to adhere to the outer surface of the freezing steel pipe, since the freezing pipe is chilled abruptly as stated (7) above, the air tends to remain in the formed ice layer in a white bubble pattern.

(10) In forming the ice layer of the skating rink, the usual practice is to form a so-called base ice on which water is sprayed with a nozzle for forming an upper layer. In this case, the ice temperature of the base ice may become too low so that the sprayed water upon contacting with the base ice is frozen and there is not sufficient time for the air contained in the spray water to be discharged from the water, the air being thus entrapped in the ice as air bubbles in the upper ice layer and interfering with formation of the uniform ice.

OBJECT OF THE INVENTION

With the foregoing in view, it is an object of the present invention to provide an ice making apparatus wherein the freezing pipe is formed by an elongated soft steel pipe mainly consisting of an iron material containing very little impurity, which is capable of being wound into, and unwound from, a coil form and having a diameter sized so as to permit convenient transport thereof and provided with a synthetic resin coating, such as polyamide coating, on the outer surface alone or on both the outer and inner surfaces of the pipe, and wherein the freezing pipe may be reduced in thickness and less liable to chemical attack or pinholes, so that the refrigerating efficiency is improved, and transport or handling thereof is simplified.

It is another object of the present invention to provide an ice making apparatus wherein the formed ice is uniform and homogeneous in quality and devoid of residual air.

It is a further object of the present invention to provide an ice making apparatus wherein the seamless tube may be laid along the length of the rink without requiring welding or the like operations.

BRIEF DESCRIPTION OF THE DRAWINGS

In the accompanying drawings,

FIG. 2 to FIG. 4 show the freezing pipe in cross-section, wherein FIG. 2 shows the pipe with a synthetic resin coating formed on the outer surface of the pipe.

FIG. 4 shows the pipe with a synthetic resin coating formed on both the outer and inner surfaces of the pipe.

FIG. 3 shows the pipe in which the synthetic resin film is coated on the outer surface in two layers.

DESCRIPTION OF PREFERRED EMBODIMENTS

Figure 1:
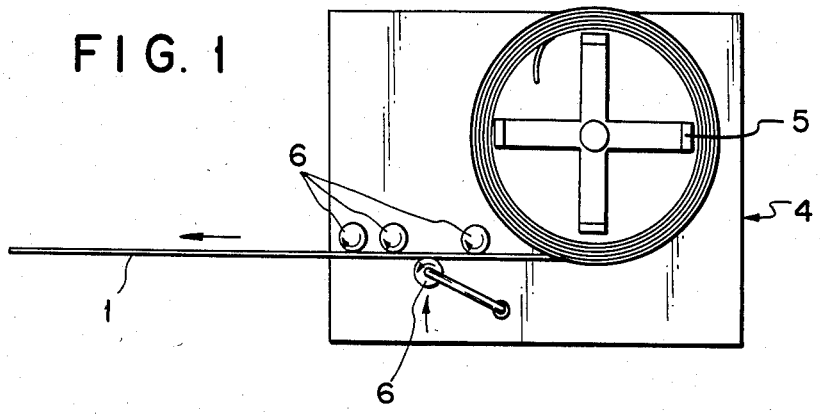
FIG. 1 is a schematic plan view of the spool device for the steel pipe according to the present invention.
Figure 2:
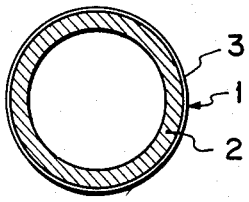

In FIGS. 1 and 2, a freezing pipe 1 for an ice rink is shown, which pipe is comprised of a soft steel pipe 2 and a coating 3 of a corrosion resistant synthetic resin, such as polyamide, applied to the outer surface of the freezing pipe.

The soft steel pipe 2 is made of an iron material containing very little impurity, with the following composition for an example;

carbon — max 0.1% preferably below 0.05%
Sulphur — max 0.02%
manganese — 0.2%
phosphorus — max 0.02%
silicon — max 0.01%
iron — remainder In the above example, the steel pipe is composed of an iron material for more than 99%, being the soft steel having substantially pure iron composition, which renders the characteristics of being readily bendable.

The soft steel pipe 2 made of a bendable material as mentioned above may be wound into a coil form while being passed between a pair of pinch rolls 6 spaced apart from each other at a distance approximately equal to the outside diameter of the pipe 2, the pinch rolls 6 pressing on sides of the pipe 2 for winding the latter into a coil form. Also the steel pipe 2 in the coil form may be straightened by acting on the opposite sides of the pipe.

The length and the outside diameter as well as wall thickness of the soft steel pipe 2 can be adjusted at the pipe manufacturing plant so that the pipe may, for an example, be of a length approximately equal to the length of the ice rink. The inside diameter of the soft steel pipe is not critical and may preferably be in the range from 10.0 to 14.0 mm when the pipe is used for the ice rink.

The synthetic coating 3 is applied as by painting or electro-deposition on the outer surface of the soft steel pipe 2 and preferably to a thickness in the range from 0.02 to 0.2 mm. In the case where a film thickness of the coating 3 is too large, the freezing action of the refrigerant passing through the pipe 1 is lowered. On the other hand, if a film thickness is too small, corrosion resistance of the pipe 1 is lowered.

Figure 3:
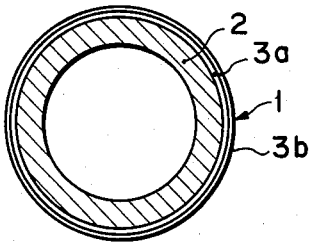
Figure 4:
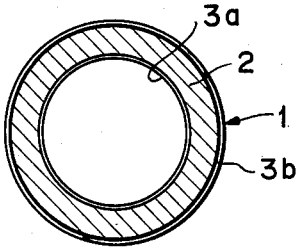

The coating 3 may be applied not only to the outer surface alone, but also to both the outer and inner surfaces of the pipe 2, as shown in FIG. 4, where the synthetic resin coating on the inner surface of the soft steel pipe 2 is designated by the reference numeral 3*a*. The inner coating 3*a* is effective to render the inner surface of the soft steel pipe 2 corrosion-proof against the freezing medium. It should be noted that the synthetic resin coating may also be applied in two layers 3*a*, 3*b* as shown in FIG. 3. For an example, a polyamid film may be applied to the inner surface of the pipe 1 to a thickness of 0.03 mm, and a polyethylene film may then be applied on the thus formed polyamide film to a thickness of 0.07 mm. In this case, the freezing action of the refrigerant passing through the pipe 1 is suitably retarded in such a manner that the ice is of a quality suitable to the ice rink with a certain economic merit.

The freezing pipe 1 is wound or extended by a device 4 shown in FIG. 1, wherein the numeral 5 denotes a spool on which the pipe 1 may be taken up in a coil pattern. The pipe 1 reeled out upon rotation of the spool 5 is straightened by a plurality of pinch rolls 6 and extended into a straight cooling pipe 1.

Figure 5:
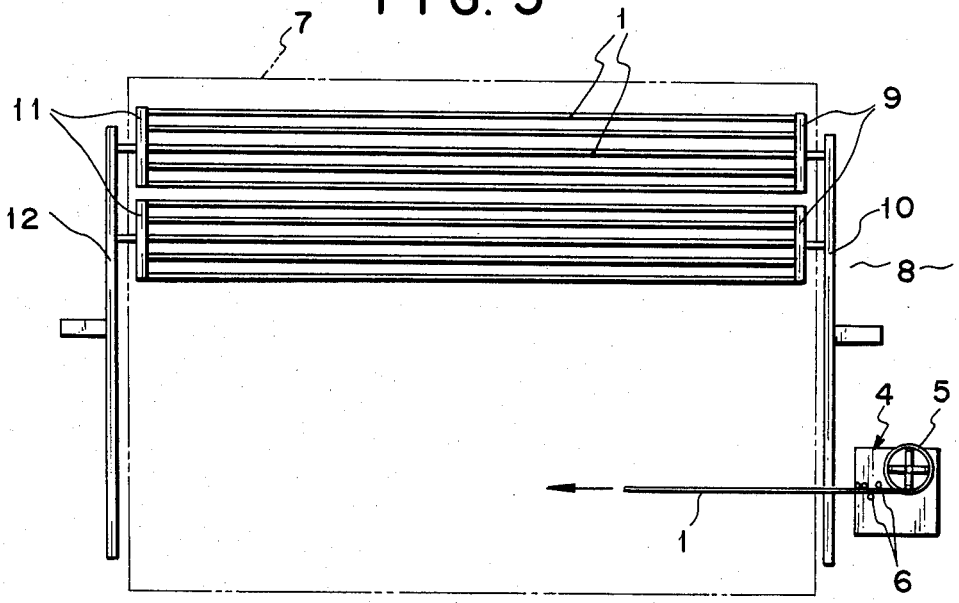
FIG. 5 is a plan view showing the skating rink.

When using the cooling pipe 1 as a refrigerant piping for the ice rink, the spool unit 4 is placed at a rink side 8 of the rink 7, as shown in FIG. 5. As the freezing pipe 1 in the coil form is reeled out upon rotation of spool 5, the pipe 1 is reeled out and extended while being straightened by pinch rolls 6. A desired number of the elongated freezing pipes 1 are reeled out in this manner and laid on a floor of the rink 7 along its length and parallel to one another. The respective freezing pipes 1 are connected at one end by a plurality of inlet sub-headers 9 to a refrigerant supply header 10, while the other end of each of the pipes is connected by outlet sub-headers 11 to a refrigerant return header 12. A large number of the refrigerant pipes 1 may be installed in such a manner that the refrigerant may flow through the pipes in one direction or alternately in opposite directions.

The cooling pipes 1 laid in parallel to one another may be secured to the rink floor by a holder or holders extending at right angles with the pipes, or may be embedded permanently into the rink floor. The ends of the cooling pipes 1 may be connected directly to the headers 10, 12 so that the subheaders 9, 11 may be dispensed with. In any case, since the freezing pipe 1 is comprised of a soft steel pipe 2 provided with an outer coating 3, the corrosion allowance of 0.5 mm is sufficient. When the steel pipe of the present embodiment with an inside diameter of 12 mm is used in Japan as a freezing pipe, the wall thickness equal to ($t+a=1.67$ mm) or more is required with a bare steel pipe, whereas the wall thickness of ($t+a=1.17$ mm) or more is sufficient in the present invention. It is to be noted that the above composition and coating materials of the soft steel pipe are given for the sake of illustration only and are not as limitations to the present invention.

The present invention gives rise to the following advantages.

(a) The freezing pipe may be reduced in wall thickness and thus may be lightweight while being of small diameter in order to facilitate transport and handling, as well as reducing manufacture costs.

(b) The pipe is corrosion and fissure-resistant (in fact, the pipe has been found experimentally to have a resistance to a temperature as low as −70° C. and to an elevated temperature of +95° C.).

(c) Since the pipe may be taken up on a spool and reeled out therefrom, it can be transported and laid easily. Since the length of the pipe corresponding to that of the freezing area of the rink may be prepared in advance the welding or the like operation may be dispensed with.

(d) The pipe is seamless and, therefore, free of weld joints, uniform freezing is achieved without the possibility of leakage of the freezing medium.

(e) The surface of the freezing pipe is not affected by air deposition by virtue of the provision of the synthetic resin coating. In addition, the freezing operation of the refrigerant through the freezing pipe is retarded so that the the resulting ice layer is rigid and free of residual air while being of uniform quality and exhibiting an optimum ice temperature.

(f) The freezing pipe may be both for a direct freezing system and for an indirect freezing system.

What is claimed is:

1. An ice making apparatus wherein a refrigerant including a liquefied gas such as freon or ammonia, or an anti-freeze liquid such as brine or ethylene glycol is circulated through a freezing pipe laid in a given area for forming an ice layer in said area, the freezing pipe being capable of being wound or extended under pressure in the longitudinal direction and is formed as an elongated soft steel pipe comprising an iron material containing very little impurity and having a coating of synthetic material at least on the outer surface of the pipe.

2. An ice making apparatus for an ice rink comprising a plurality of freezing pipes laid along the length of the ice forming area of the ice rink floor, with one end of each of the freezing pipes being connected to a refrigerant supply header and the other end of each of the pipes being connected to a refrigerant outlet header, the refrigerant being circulated through these freezing pipes for forming the ice layer on the ice rink, each of said freezing pipes being an elongated soft steel pipe comprising an iron material containing very little impurity and capable of being wound and extended in the longitudinal direction, said pipes being coated at least on the outer surface thereof with synthetic resin, said soft steel pipes being laid in parallel with one another along the length of the rink floor in such a manner that the one end of each of the soft steel pipes is connectedto a refrigerant supply header with or without the intermediary of a sub-header while the other end of each of the pipes is connected to a refrigerant outlet header with or without the intermediary of a sub-header.

3. The ice making apparatus as claimed in claim 2 wherein said coating is a polyamid resin coating.

4. The ice making apparatus as claimed in claim 2 wherein said coating is a dual layer coating.

5. The ice making apparatus as claimed in claim 4 wherein the coating on the outer surface of the soft steel pipe is of a dual structure consisting of a polyamide inner coating layer and a polyethylene outer coating layer.

6. The ice making apparatus as claimed in claim 2, wherein the synthetic resin coating on the outer surface of the soft steel pipe has a thickness in the range of 0.02 to 0.2mm.

7. The ice making apparatus as claimed in claim 3 wherein the synthetic resin coating on the outer surface of the soft steel pipe has a thickness of the range of 0.02 to 0.2mm.

8. The icemaking apparatus as claimed in claim 4 wherein the synthetic resin coating on the outer surface of the soft steel pipe has a thickness in the range of 0.02 to 0.2mm.

9. The ice making apparatus as claimed in claim 5 wherein the synthetic resin coating on the outer surface of the soft steel pipe has a thickness in the range of 0.02 to 0.2mm.

10. The ice making apparatus as claimed in claim 1, wherein the steel pipe is comprised of at least 99% iron.

11. The ice making apparatus as claimed in claim 2, wherein the steel pipe is comprised of at least 99% iron.

* * * * *